US011674478B2

(12) United States Patent
Suzuki et al.

(10) Patent No.: US 11,674,478 B2
(45) Date of Patent: Jun. 13, 2023

(54) AIR INTAKE AMOUNT MEASUREMENT DEVICE AND ENGINE

(71) Applicant: KUBOTA CORPORATION, Osaka (JP)

(72) Inventors: Yu Suzuki, Sakai (JP); Yuki Yoshita, Sakai (JP); Kazuya Ishida, Sakai (JP); Satoshi Shibata, Sakai (JP); Katsunori Ikemachi, Sakai (JP); Masayasu Takami, Sakai (JP); Tomohiro Suzuki, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/786,518

(22) PCT Filed: Mar. 9, 2021

(86) PCT No.: PCT/JP2021/009372
§ 371 (c)(1),
(2) Date: Jun. 16, 2022

(87) PCT Pub. No.: WO2021/193036
PCT Pub. Date: Sep. 30, 2021

(65) Prior Publication Data

US 2022/0325682 A1 Oct. 13, 2022

(30) Foreign Application Priority Data

Mar. 27, 2020 (JP) ..... JP2020-057910
Aug. 7, 2020 (JP) ..... JP2020-135352

(51) Int. Cl.
*F02M 26/05* (2016.01)
*F02M 26/47* (2016.01)
(Continued)

(52) U.S. Cl.
CPC ..... *F02M 26/05* (2016.02); *F02M 26/47* (2016.02); *F02M 35/10222* (2013.01); *F02M 35/112* (2013.01); *F02M 35/1038* (2013.01)

(58) Field of Classification Search
CPC .. F02M 26/05; F02M 26/47; F02M 35/10144; F02M 35/10222; F02M 35/1038; F02M 35/10386; F02M 35/112
See application file for complete search history.

(56) References Cited

U.S. PATENT DOCUMENTS 10,100,719 B2 * 10/2018 Moore ..... F02M 35/10157
2008/0121211 A1 * 5/2008 Livshiz ..... F02M 35/1038 123/349

(Continued)

FOREIGN PATENT DOCUMENTS

JP 2005-194943 A 7/2005
JP 2005-299591 A 10/2005

(Continued)

*Primary Examiner* — Logan M Kraft
*Assistant Examiner* — Anthony L Bacon
(74) *Attorney, Agent, or Firm* — Muncy, Geissler, Olds & Lowe, P.C.

(57) ABSTRACT

An air intake amount measurement device 200 includes an intake distributor 3 distributing intake air CYL to cylinders 11, 12, 13, and 14, a temperature detector 202 detecting a temperature Ti of the intake air CYL, a pressure detector 201 for detecting a pressure Pi of intake air CL, and a computing unit 100 that computes an air intake amount mfcyl of the intake air CYL on the basis of the temperature Ti transmitted from the temperature detector 202 and the pressure Pi transmitted from the pressure detector 201. The temperature detector 202 detects the temperature Ti of the intake air CYL at a region W spanning, out of an inside of the intake distributor 3, a first branch portion 31 and a second branch portion 32.

10 Claims, 6 Drawing Sheets

(51) Int. Cl.
*F02M 35/112* (2006.01)
*F02M 35/10* (2006.01)

(56) References Cited

U.S. PATENT DOCUMENTS

| | | | | |
|---|---|---|---|---|
| 2011/0167815 | A1* | 7/2011 | Ulrey | F02D 13/02 60/299 |
| 2011/0265772 | A1* | 11/2011 | Teng | F02M 26/05 123/568.11 |
| 2013/0133631 | A1 | 5/2013 | Graze, Jr. | |
| 2015/0267633 | A1* | 9/2015 | Nakano | F01M 13/028 73/114.77 |
| 2016/0169171 | A1* | 6/2016 | Newman | B60K 5/04 29/525.01 |
| 2019/0063376 | A1* | 2/2019 | Ebesu | F02M 26/30 |

FOREIGN PATENT DOCUMENTS

| | | | |
|---|---|---|---|
| JP | 2010-285957 | A | 12/2010 |
| JP | 2011-185263 | A | 9/2011 |
| JP | 2018-145927 | A | 9/2018 |

* cited by examiner

AIR INTAKE AMOUNT MEASUREMENT DEVICE AND ENGINE

TECHNICAL FIELD

The present invention relates to an air intake amount measurement device that measures the flow rate of intake air flowing through air intake piping of an engine, and to an engine.

BACKGROUND ART

PTL 1 discloses an air intake control device of an engine provided with a MAF sensor. The MAF sensor described in PTL 1 is provided to an air intake pipe, on an upstream side from a turbocharger, and detects the flow rate of intake air flowing through the air intake pipe. As with the engine disclosed in PTL 1, generally, in internal combustion engines such as diesel engines or the like, a hot wire type air intake amount sensor (MAF sensor), for example, that detects air intake amount of air (intake air) flowing through air intake piping, is provided in the air intake piping. Note that the air intake amount is the flow rate of air (intake air) flowing through the air intake piping, and is also referred to as intake air flow rate, MAF, or the like.

However, output characteristics of air intake amount sensors provided in the air intake piping have a problem of being dependent on the shape of an intake system (e.g., air intake piping) on the upstream side from the air intake amount sensor. The intake system on the upstream side of the air intake amount sensor differs for each application installed in, for example, industrial diesel engines and so forth. Accordingly, calibration work of the air intake amount sensor becomes necessary for each application installed in the engine, which is troublesome.

CITATION LIST

Patent Literature

[PTL 1] Japanese Patent Application Publication No. 2010-285957

SUMMARY OF INVENTION

Technical Problem

The present invention has been made to solve the problem, and it is an object thereof to provide an air intake amount measurement device and an engine, in which dependency of measurement results of the flow rate of intake air flowing through air intake piping on the shape of the air intake piping can be suppressed, and the flow rate of intake air can be measured in a stable manner.

Solution to Problem

The problem is solved by an air intake amount measurement device according to the present invention that measures a flow rate of intake air of an engine that has three or more inline cylinders. The air intake amount measurement device includes: an intake distributor distributing the intake air to the cylinders of the engine; a temperature detector detecting a temperature of the intake air; a pressure detector detecting a pressure of the intake air; and a computing unit that computes the flow rate on the basis of the temperature transmitted from the temperature detector and the pressure transmitted from the pressure detector. A longitudinal direction of the intake distributor follows a direction in which the cylinders of the engine are arrayed, the intake air flows into the intake distributor from one end thereof in the longitudinal direction, and the temperature detector detects the temperature of the intake air at a region spanning, out of an inside of the intake distributor, a first branch portion of the intake distributor that is connected to a first cylinder of the engine disposed at a position farthest from the one end in the longitudinal direction, and a second branch portion of the intake distributor that is connected to a second cylinder of the engine disposed at a position next farthest from the one end in the longitudinal direction after the first cylinder.

According to the air intake amount measurement device of the present invention, the longitudinal direction of the intake distributor that distributes the intake air to the cylinders of the engine follows the direction in which the cylinders of the engine are arrayed. The intake air of the engine flows into the intake distributor from one end in the longitudinal direction of the intake distributor. The computing unit computes the flow rate of the intake air on the basis of the temperature of the intake air transmitted from the temperature detector and the pressure of the intake air transmitted from the pressure detector. The temperature detector detects the temperature of the intake air at a region spanning the first branch portion of the intake distributor and the second branch portion of the intake distributor. The first branch portion is connected to the first cylinder of the engine disposed at a position farthest from the one end of the intake distributor in the longitudinal direction of the intake distributor. The second branch portion is connected to the second cylinder of the engine disposed at a position next farthest from the one end of the intake distributor after the first cylinder of the engine in the longitudinal direction of the intake distributor. Thus, the temperature detector detects the temperature of the intake air at a region where the flow of the intake air is relatively stable out of the regions in the intake distributor. The computing unit computes the flow rate of the intake air on the basis of the temperature of the intake air transmitted from the temperature detector and the pressure of the intake air transmitted from the pressure detector without depending on an air intake amount sensor (MAF sensor) that detects the flow rate of the intake air flowing through the intake piping. Accordingly, the air intake amount measurement device according to the present invention can measure the flow rate of the intake air in a stable manner, suppressing the measurement results of the flow rate of the intake air flowing through the intake piping from being dependent on the shape of the intake piping.

In the air intake amount measurement device according to the present invention, the pressure detector preferably detects the pressure of the intake air at the region.

According to the air intake amount measurement device of the present invention, in the same way as with the temperature detector, the pressure detector detects the pressure of the intake air at a region where the flow of the intake air is relatively stable out of the regions in the intake distributor. The computing unit computes the flow rate of the intake air on the basis of the temperature of the intake air transmitted from the temperature detector and the pressure of the intake air transmitted from the pressure detector without depending on an air intake amount sensor (MAF sensor). Thus, the air intake amount measurement device according to the present invention can measure the flow rate of the intake air in an even more stable manner, further suppressing the measurement results of the flow rate of the intake air flowing through the intake piping from being dependent on the shape of the intake piping.

In the air intake amount measurement device according to the present invention, the pressure detector preferably detects the pressure of the intake air at a position closer to the one end in the longitudinal direction as compared to the intake air of which the temperature is detected by the temperature detector.

According to the air intake amount measurement device of the present invention, the pressure detector detects the pressure of the intake air at a position in the intake distributor closer to the one end in the longitudinal direction of the intake distributor as compared to the intake air of which the temperature is detected by the temperature detector. Accordingly, the pressure detector detects the pressure not of the intake air in a region where the flow has been disturbed by a probe or the like of the temperature detector installed in the intake distributor for example, but of the intake air in a region before disturbance of the flow, where the flow is more stable. Therefore, the pressure detector can detect the pressure of the intake air in a more stable manner. Thus, the air intake amount measurement device according to the present invention can measure the flow rate of the intake air in an even more stable manner, further suppressing the measurement results of the flow rate of the intake air flowing through the intake piping from being dependent on the shape of the intake piping.

The air intake amount measurement device according to the present invention preferably further includes an exhaust circulator circulating exhaust of the engine; and a differential pressure detector detecting a differential pressure between the exhaust flowing through the exhaust circulator and the intake air flowing through the intake distributor, and transmits the differential pressure to the computing unit, the computing unit further computing the flow rate on the basis of the differential pressure transmitted from the differential pressure detector, and the differential pressure detector detecting the differential pressure on the basis of the pressure of the intake air at the region.

According to the air intake amount measurement device of the present invention, the air intake amount measurement device further includes an exhaust circulator circulating exhaust of the engine and a differential pressure detector. The computing unit further computes the flow rate of the intake air on the basis of the differential pressure of the exhaust and the intake air transmitted from the differential pressure detector. The differential pressure detector detects the differential pressure of the exhaust flowing through the exhaust circulator and the intake air flowing through the intake distributor, and transmits the differential pressure to the computing unit. Now, the differential pressure detector detects the differential pressure of the exhaust and the intake air on the basis of the pressure of the intake air at the region spanning the first branch portion and the second branch portion. That is to say, the detection region of the pressure of the intake air by the differential pressure detector is the same as the detection region of the pressure of the intake air by the pressure detector, i.e., the region spanning the first branch portion and the second branch portion. Accordingly, in a case of providing an exhaust circulator circulating exhaust of the engine, the air intake amount measurement device according to the present invention can improve the computation precision of the flow rate of the intake air flowing through the intake piping.

In the air intake amount measurement device according to the present invention, the differential pressure detector preferably detects the differential pressure on the basis of the pressure of the intake air at a position closer to the one end in the longitudinal direction as compared to the intake air of which the temperature is detected by the temperature detector.

According to the air intake amount measurement device of the present invention, the differential pressure detector detects the differential pressure of the exhaust and the intake air on the basis of the pressure of the intake air at a position closer to the one end of the intake distributor in the longitudinal direction of the intake distributor as compared to the intake air of which the temperature is detected by the temperature detector. Accordingly, a differential pressure detector detects the differential pressure of the exhaust and the intake air on the basis of not the pressure of the intake air in a region where the flow has been disturbed by a probe or the like of the temperature detector installed in the intake distributor for example, but of the intake air in a region before disturbance of the flow, where the flow is more stable. Thus, the differential pressure detector can detect the differential pressure of the exhaust and the intake air in a more stable manner. Accordingly, in a case of providing an exhaust circulator circulating exhaust of the engine, the air intake amount measurement device according to the present invention can improve the computation precision of the flow rate of the intake air flowing through the intake piping even further.

In the air intake amount measurement device according to the present invention, the differential pressure detector preferably detects the differential pressure on the basis of the pressure of the intake air at a same position in the longitudinal direction as the intake air of which the pressure is detected by the pressure detector.

According to the air intake amount measurement device of the present invention, the differential pressure detector detects the differential pressure of the exhaust and the intake air on the basis of the pressure of the intake air at the same position in the longitudinal direction of the intake distributor as the intake air of which the pressure is detected by the pressure detector. That is to say, the detection position of the pressure of the intake air by the differential pressure detector is the same as the detection position of the pressure of the intake air by the pressure detector, i.e., the position of the region spanning the first branch portion and the second branch portion. Accordingly, the pressure of the intake air in the intake distributor for detecting the differential pressure by the differential pressure detector and the pressure of the intake air in the intake distributor that is detected by the pressure detector are temporally synchronized with each other. Thus, the computing unit calculates the flow rate of the intake air flowing through the intake distributor and the flow rate of the exhaust flowing through the exhaust circulator from one system in the intake distributor, i.e., a system of which the state is the same. Accordingly, in a case of providing an exhaust circulator circulating exhaust of the engine, the air intake amount measurement device according to the present invention can improve the computation precision of the flow rate of the intake air flowing through the intake piping even further.

In the air intake amount measurement device according to the present invention, the differential pressure detector preferably detects the differential pressure on the basis of the pressure of the exhaust between a cooler cooling the exhaust flowing through the exhaust circulator, and a flow rate adjustor adjusting a flow rate of the exhaust flowing through the exhaust circulator on a downstream side of the cooler.

According to the air intake amount measurement device of the present invention, the differential pressure detector detects the differential pressure of the exhaust and the intake air on the basis of the pressure of the exhaust between a cooler and a flow rate adjustor provided on a downstream side of the cooler. Accordingly, the computing unit can estimate the state of deterioration or the degree of deterioration of the cooler on the basis of the differential pressure transmitted from the differential pressure detector.

The air intake amount measurement device according to the present invention preferably further includes: a spacer provided to the exhaust circulator between the cooler and the flow rate adjustor, the spacer having a hole formed passing through in a direction intersecting a flow of the exhaust flowing through the exhaust circulator, and the differential pressure detector detecting the differential pressure on the basis of the pressure of the exhaust extracted through the hole of the spacer.

According to the air intake amount measurement device of the present invention, in a case of providing an exhaust circulator circulating exhaust of the engine, the spacer is provided to the exhaust circulator between the cooler for cooling the exhaust and the flow rate adjustor for adjusting the flow rate of the exhaust. The differential pressure detector detects the differential pressure on the basis of the pressure of the exhaust extracted through the hole of the spacer. Accordingly, the path of piping or the like that conveys the pressure of the exhaust to the differential pressure detector is capable of being connected to the spacer in a sure manner, without hardly being subjected to any structural restriction from the cooler and the flow rate adjustor. Also, the path made up of various types of piping and so forth to convey the pressure of the exhaust to the differential pressure detector can be easily connected to the spacer even without changing the structures of the cooler and the flow rate adjustor, by changing the structure of the spacer. Further, the hole of the spacer is formed passing through in a direction intersecting the flow of the exhaust flowing through the exhaust circulator. Accordingly, the hole of the spacer can be suppressed from being blocked by particulate matter (PM: Particulate Matter) contained in the exhaust. Thus, the differential pressure detector can acquire the pressure (static pressure) of the exhaust in a more sure manner, and can detect the differential pressure on the basis of the pressure (static pressure) of the exhaust with even higher precision.

The air intake amount measurement device according to the present invention preferably further includes: an exhaust pressure acquiring path that is connected to the spacer and the differential pressure detector, and that conveys a pressure of the exhaust extracted through the hole to the differential pressure detector, at least a portion of the exhaust pressure acquiring path connected to the spacer being made of metal.

According to the air intake amount measurement device of the present invention, the exhaust pressure acquiring path is connected to the spacer and the differential pressure detector, and the pressure of the exhaust extracted through the hole of the spacer is conveyed to the differential pressure detector. Also, at least a portion of the exhaust pressure acquiring path connected to the spacer is made of metal. Accordingly, the portion of the exhaust pressure acquiring path that is connected to the spacer can be suppressed from deteriorating or hardening under heat of the exhaust flowing through the exhaust circulator. Thus, a gap can be suppressed from being formed between the portion of the exhaust pressure acquiring path that is connected to the spacer, and the spacer, and air on the outside of the exhaust pressure acquiring path can be suppressed from intruding into the exhaust pressure acquiring path. Accordingly, the differential pressure detector can detect the differential pressure with even higher precision. Also, the portion of the exhaust pressure acquiring path that is connected to the spacer is made of metal, and accordingly the exhaust pressure acquiring path can be fastened to the spacer using a screw structure. Thus, the exhaust pressure acquiring path can be suppressed from coming loose from the spacer, and positioning of the exhaust pressure acquiring path to the spacer can be easily performed.

Also, the problem is solved by an engine according to the present invention that is equipped with an air intake amount measurement device that measures a flow rate of intake air, and that has three or more inline cylinders. The air intake amount measurement device includes an intake distributor distributing the intake air to the cylinders of the engine, a temperature detector detecting a temperature of the intake air, a pressure detector detecting a pressure of the intake air, and a computing unit that computes the flow rate on the basis of the temperature transmitted from the temperature detector and the pressure transmitted from the pressure detector. A longitudinal direction of the intake distributor follows a direction in which the cylinders of the engine are arrayed. The intake air flows into the intake distributor from one end thereof in the longitudinal direction. The temperature detector detects the temperature of the intake air at a region spanning, out of an inside of the intake distributor, a first branch portion of the intake distributor that is connected to a first cylinder of the engine disposed at a position farthest from the one end in the longitudinal direction, and a second branch portion of the intake distributor that is connected to a second cylinder of the engine disposed at a position next farthest from the one end in the longitudinal direction after the first cylinder.

According to the engine equipped with the air intake amount measurement device of the present invention, the longitudinal direction of the intake distributor that distributes the intake air to the cylinders of the engine follows the direction in which the cylinders of the engine are arrayed. The intake air of the engine flows into the intake distributor from one end in the longitudinal direction of the intake distributor. The computing unit computes the flow rate of the intake air on the basis of the temperature of the intake air transmitted from the temperature detector and the pressure of the intake air transmitted from the pressure detector. The temperature detector detects the temperature of the intake air at a region spanning the first branch portion of the intake distributor and the second branch portion of the intake distributor. The first branch portion is connected to the first cylinder of the engine disposed at a position farthest from the one end of the intake distributor in the longitudinal direction of the intake distributor. The second branch portion is connected to the second cylinder of the engine disposed at a position next farthest from the one end of the intake distributor after the first cylinder of the engine in the longitudinal direction of the intake distributor. Thus, the temperature detector detects the temperature of the intake air at a region where the flow of the intake air is relatively stable out of the regions in the intake distributor. The computing unit computes the flow rate of the intake air on the basis of the temperature of the intake air transmitted from the temperature detector and the pressure of the intake air transmitted from the pressure detector without depending on an air intake amount sensor (MAF sensor) that detects the flow rate of the intake air flowing through the intake piping. Accordingly, the engine equipped with the air intake amount measurement device according to the present invention can measure the flow rate of the intake air in a stable manner, suppressing the measurement results of the flow rate of the intake air flowing through the intake piping from being dependent on the shape of the intake piping.

Advantageous Effects of Invention

According to the present invention an air intake amount measurement device and an engine, in which dependency of measurement results of the flow rate of intake air flowing through air intake piping on the shape of the air intake piping can be suppressed and the flow rate of intake air can be measured in a stable manner, can be provided.

DESCRIPTION OF EMBODIMENTS

A preferred embodiment of the present invention will be described below in detail with reference to the figures. It should be noted that due to being a preferred specific example of the present invention, the embodiment described below has various limitations that are technically preferred, but the scope of the present invention is not limited to these forms unless specifically stated in the following description that the present invention is to be limited. Also, components that are the same in the figures are denoted by the same signs, and detailed description will be omitted as appropriate.

(Overview of Engine 1)

Figure 1:
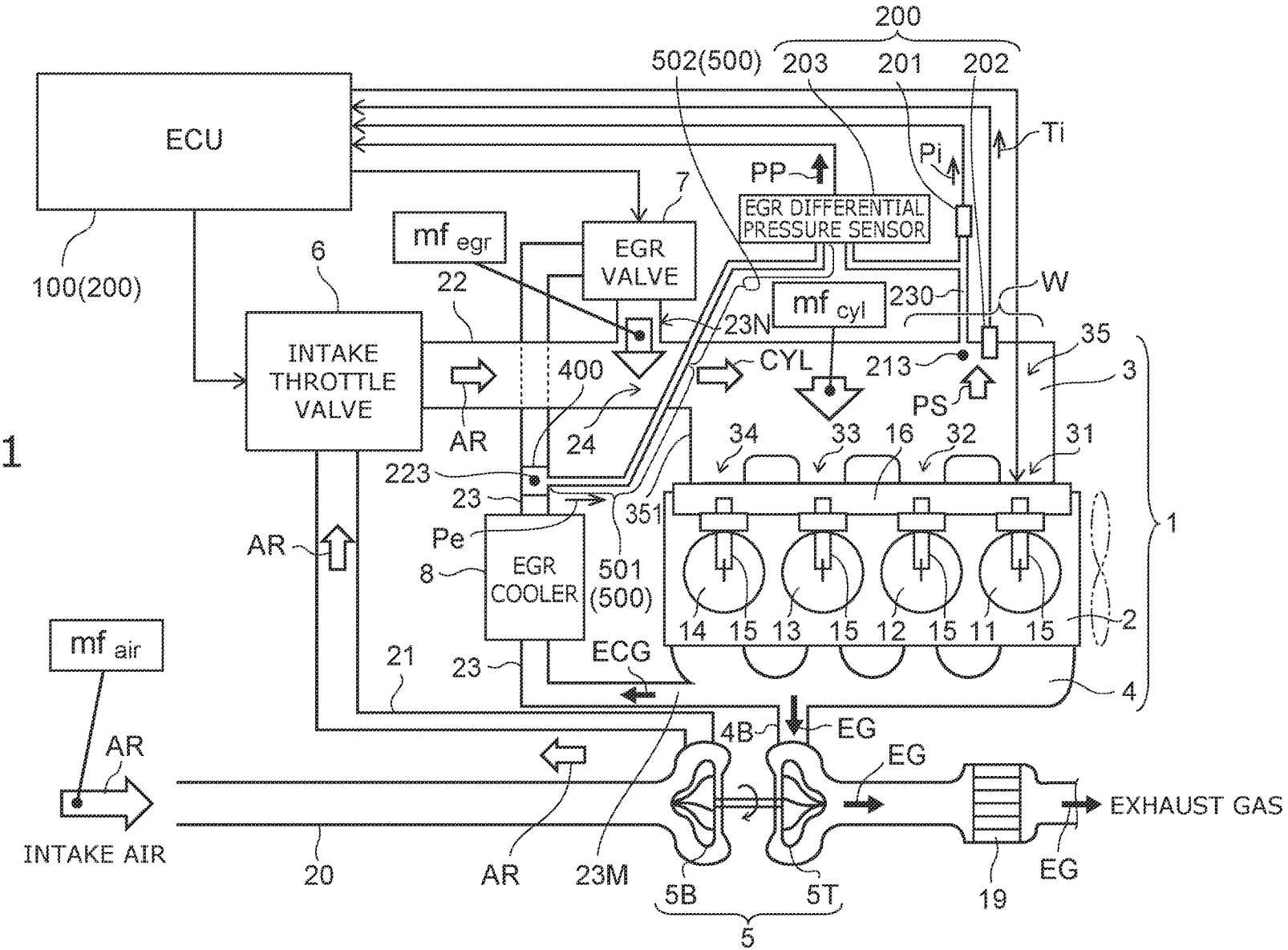
FIG. 1 is a schematic diagram illustrating an engine provided with an air intake amount measurement device according to an embodiment of the present invention.

FIG. 1 is a schematic view illustrating an engine provided with an air intake amount measurement device according to the embodiment of the present invention.

First, an overview of the engine 1 provided with the air intake amount measurement device according to the present embodiment will be described. The engine 1 illustrated in FIG. 1 is an internal combustion engine, and is an industrial diesel engine, for example. The engine 1 is an upright inline multicylinder engine, such as a supercharged high-output four-cylinder engine or the like, equipped with a turbocharger, for example. The engine 1 is installed in vehicles such as, for example, construction equipment, farming equipment, lawnmowers, and so forth.

The engine 1 illustrated in FIG. 1 includes a cylinder head 2, an intake manifold (intake manifold) 3, an exhaust manifold (exhaust manifold) 4, a turbocharger 5, an intake throttle valve (intake adjustment unit) 6, an EGR (Exhaust Gas Recirculation: exhaust gas recirculation) valve 7, an EGR cooler 8, and an air intake amount measurement device 200 that has an ECU (Electronic Control Unit: electronic control unit, control unit) 100. Note that providing an exhaust circulator circulating the exhaust of the engine 1, such as the EGR valve 7, the EGR cooler 8, and a EGR gas path 23, which will be described later, is not necessarily required. "Manifold" may also be referred to as "manifold". Also, the intake manifold 3 according to the present embodiment is an example of "intake distributor" according to the present invention. The ECU 100 according to the present embodiment is an example of a "computing unit" according to the present invention. The EGR valve 7 according to the present embodiment is an example of "flow rate adjustor" according to the present invention. The EGR cooler 8 according to the present embodiment is an example of "cooler" according to the present invention.

The cylinder head 2 of the engine 1 is a cylinder head of an upright inline multicylinder engine that has a first cylinder 11, a second cylinder 12, a third cylinder 13, and a fourth cylinder 14, for example. In the present Specification, the cylinders will be referred to as first cylinder, second cylinder, third cylinder, and fourth cylinder, in that order from cylinders provided at positions far away from a portion (mixing portion) 24 at which intake air AR that has passed through the intake throttle valve 6 and exhaust circulation gas ECG that has passed through the EGR valve 7 are mixed with each other, toward cylinders provided at positions near thereto, when viewing following the direction in which the plurality of cylinders are arrayed, i.e., the direction in which a crankshaft extends.

As illustrated in FIG. 1, the intake manifold 3 has a main pipe 35 that has an inlet end 351 at which intake air flows in on one end thereof, and a first branch pipe 31, a second branch pipe 32, a third branch pipe 33, and a fourth branch pipe 34, that branch from the main pipe 35. The inlet end 351 according to the present embodiment is an example of "one end" according to the present invention. The first branch pipe 31, the second branch pipe 32, the third branch pipe 33, and the fourth branch pipe 34 according to the present embodiment respectively are examples of "first branch portion", "second branch portion", "third branch portion", and "fourth branch portion", according to the present invention. A longitudinal direction of the main pipe 35 extends following a direction in which the first cylinder 11, the second cylinder 12, the third cylinder 13, and the fourth cylinder 14 are arrayed, i.e., in the direction in which the crankshaft extends. The first branch pipe 31, the second branch pipe 32, the third branch pipe 33, and the fourth branch pipe 34 of the intake manifold 3 are respectively connected to the first cylinder 11, the second cylinder 12, the third cylinder 13, and the fourth cylinder 14. A fuel injection valve 15 is provided in each combustion chamber of the first cylinder 11, the second cylinder 12, the third cylinder 13, and the fourth cylinder 14. The fuel injection valves 15 are connected to a common rail 16. Fuel from a fuel tank that is omitted from illustration is fed to the common rail 16 by operations of a fuel pump. The common rail 16 performs compression and accumulation of fuel fed from the fuel pump, under control of the ECU 100. The fuel compressed and accumulated at the common rail 16 is injected from the fuel injection valves 15 into the combustion chambers.

(Turbocharger 5)

As illustrated in FIG. 1, the turbocharger 5 has a turbine 5T and a blower 5B, and supercharges intake air to be fed to the intake manifold 3. That is to say, the portion of the blower 5B is connected to an intake piping 20 and an intake channel 21. The intake channel 21 is connected to an inlet flange 22 of the intake manifold 3 via the intake throttle valve 6. The portion of the turbine 5T is connected to an exhaust channel 4B. Upon exhaust gas EG guided through the exhaust channel 4B of the exhaust manifold 4 being supplied to the turbine 5T of the turbocharger 5, the turbine 5T and the blower 5B rotate at high speed. Due to the blower 5B rotating at high speed, intake air AR that is supplied to the blower 5B of the turbocharger 5 and is compressed is supercharged to the intake manifold 3 via the intake channel 21.

The exhaust gas EG discharged from the turbine 5T is externally discharged from the engine 1 via a DPF (Diesel particulate filter: diesel particulate filter) 19 or the like.

As illustrated in FIG. 1, an inlet end 23M of the EGR gas path 23 serving as an exhaust circulation path is connected to the exhaust manifold 4. Alternatively, the inlet end 23M of the EGR gas path 23 may be connected to the exhaust channel 4B between the exhaust manifold 4 and the turbine 5T. The EGR gas path 23 in the present embodiment is an example of "exhaust circulator" according to the present invention. A terminal end 23N of the EGR gas path 23 is connected to the inlet flange 22 between the intake throttle valve 6 and the inlet end 351 of the intake manifold 3. The EGR gas path 23 is provided with the EGR valve 7, the EGR cooler 8, and a spacer 400. The EGR cooler 8 cools the exhaust circulation gas ECG flowing through the EGR gas path 23.

The ECU 100 controls operations of the intake throttle valve 6, the EGR valve 7, the common rail 16, and so forth. The intake throttle valve 6 controls the supply amount of the intake air AR supplied to the inlet flange 22 of the intake manifold 3 on the basis of the amount of depression of an accelerator pedal, under instructions of the ECU 100. The EGR valve 7 adjusts the supply amount of the exhaust circulation gas ECG to be supplied from the exhaust manifold 4 to the inlet flange 22 of the intake manifold 3 under instructions of the ECU 100.

(Air Intake Amount Measurement Device 200)

Next, the air intake amount measurement device 200 according to the present embodiment will be described.

The air intake amount measurement device 200 includes a pressure sensor 201, a temperature sensor 202, an EGR differential pressure sensor 203, and the ECU 100. The pressure sensor 201 in the present embodiment is an example of "pressure detector" according to the present invention. The temperature sensor 202 in the present embodiment is an example of "temperature detector" according to the present invention. The EGR differential pressure sensor 203 in the present embodiment is an example of "differential pressure detector" according to the present invention.

The pressure sensor 201 detects a pressure Pi of mixed intake air CYL at a first pressure measurement unit 213 installed in the intake manifold 3, and transmits the pressure Pi to the ECU 100. Specifically, an intake pressure acquiring path 230 of piping or the like is connected to the intake manifold 3, the pressure sensor 201, and the EGR differential pressure sensor 203. The pressure sensor 201 detects the pressure Pi of the mixed intake air CYL that has been extracted through the intake pressure acquiring path 230 and conveyed, at the first pressure measurement unit 213. The mixed intake air CYL is gas in which the intake air AR that has passed through the intake throttle valve 6 and the exhaust circulation gas ECG that has passed through the EGR valve 7 are mixed with each other.

The temperature sensor 202 is installed in the intake manifold 3, detects a temperature Ti of the mixed intake air CYL in the intake manifold 3, and transmits the temperature Ti to the ECU 100.

The EGR differential pressure sensor 203 detects a differential pressure PP between the pressure Pi of the mixed intake air CYL at the first pressure measurement unit 213 and a pressure Pe of the exhaust circulation gas ECG at a second pressure measurement unit 223 installed in the EGR gas path 23, and transmits the differential pressure PP to the ECU 100. Specifically, as illustrated in FIG. 1, the intake pressure acquiring path 230 branches into a portion connected to the pressure sensor 201, and a portion connected to the EGR differential pressure sensor 203, from the intake manifold 3 toward the pressure sensor 201 and the EGR differential pressure sensor 203. The EGR differential pressure sensor 203 detects the differential pressure PP on the basis of the pressure Pi of the mixed intake air CYL at the first pressure measurement unit 213, which has been extracted through the intake pressure acquiring path 230 and conveyed. That is to say, the EGR differential pressure sensor 203 detects the differential pressure PP on the basis of the pressure Pi of the mixed intake air CYL at the same position as the mixed intake air CYL of which the pressure Pi is detected by the pressure sensor 201. In other words, the pressure sensor 201 and the EGR differential pressure sensor 203 detect the pressure Pi of the mixed intake air CYL at the first pressure measurement unit 213 temporally synchronized with each other in the intake manifold 3. Also, the second pressure measurement unit 223 is installed in the EGR gas path 23 between the EGR cooler 8 and the EGR valve 7. Specifically, an exhaust pressure acquiring path 500 of piping or the like is connected to the EGR gas path 23 and the EGR differential pressure sensor 203. The EGR differential pressure sensor 203 detects the differential pressure PP on the basis of the pressure Pe of the exhaust circulation gas ECG that has been extracted through the exhaust pressure acquiring path 500 and conveyed, at the second pressure measurement unit 223. Note that details of the installation positions of the first pressure measurement unit 213 and the temperature sensor 202 will be described later.

As illustrated in FIG. 1, the spacer 400 is provided in the EGR gas path 23 between the EGR cooler 8 serving as the cooler and the EGR valve 7 serving as the flow rate adjustor. The spacer 400 is made of a metal having heat resisting properties, such as stainless steel, iron, or the like, for example. The second pressure measurement unit 223 is preferably set in the spacer 400 that is made of metal. The exhaust pressure acquiring path 500 is connected to the spacer 400 and to the EGR differential pressure sensor 203.

The exhaust pressure acquiring path 500 has a first portion 501 that is connected to the spacer 400, and a second portion 502 that is connected to the first portion 501 and also is connected to the EGR differential pressure sensor 203. Of the exhaust pressure acquiring path 500, at least the first portion 501 that is connected to the spacer 400 is made of a metal having heat resisting properties, such as stainless steel, iron, or the like, for example. The second portion 502 that is the remainder of the exhaust pressure acquiring path 500 is made of a resin such as engineering plastic, rubber, or the like, which is flexible and is tolerant of heat. A specific configuration example of the spacer 400 and the exhaust pressure acquiring path 500 will be described with reference to FIG. 5, and a configuration example of the spacer 400 will be described with reference to FIG. 6.

Figure 5:
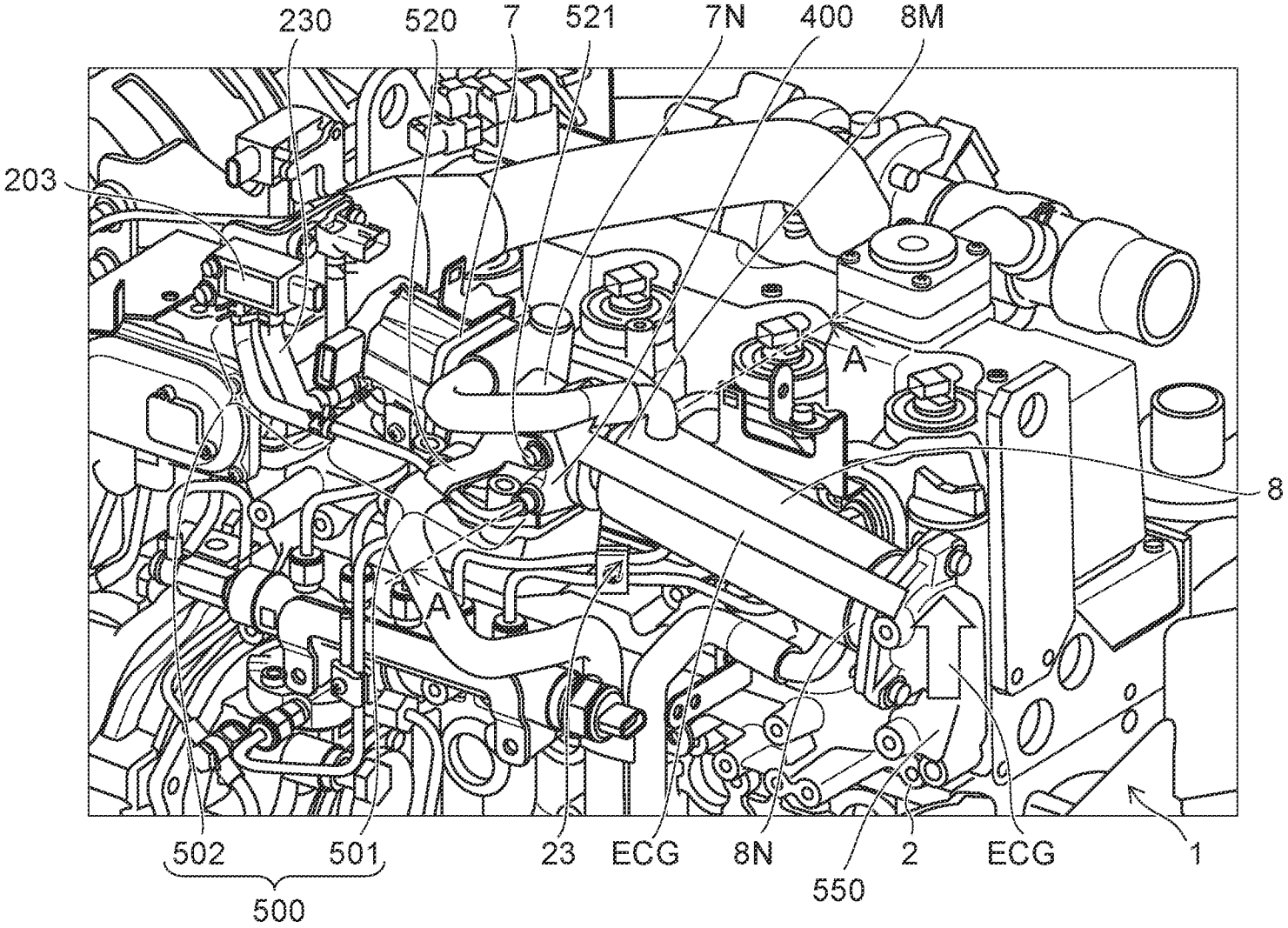
FIG. 5 is a perspective view illustrating a specific structural example of a spacer and exhaust pressure acquiring path according to the present embodiment.

FIG. 5 is a perspective view illustrating a specific structural example of the spacer and the exhaust pressure acquiring path according to the present embodiment.

Figure 6:
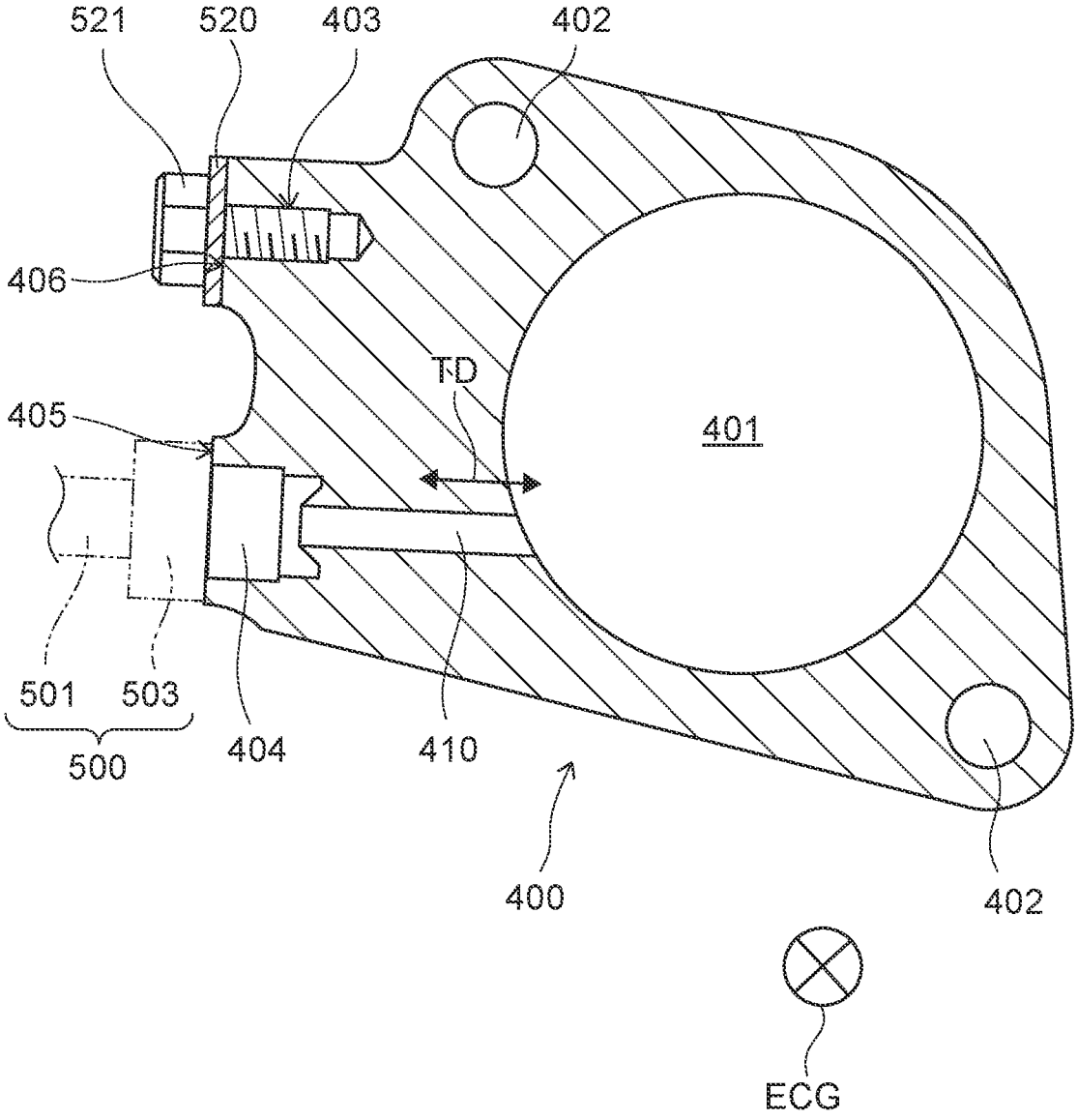
FIG. 6 is a cross-sectional view illustrating a structural example of the spacer according to the present embodiment.

FIG. 6 is a cross-sectional view illustrating a structural example of the spacer according to the present embodiment.

Note that FIG. 6 is a cross-sectional view taken along a plane of section A-A (see FIG. 5) that is perpendicular to the direction of flow of the exhaust circulation gas ECG flowing through the EGR gas path 23.

As illustrated in FIG. 5, the spacer 400 is attached between the EGR cooler 8 and the EGR valve 7. An EGR cooler base 550 illustrated in FIG. 5 is fixed to the cylinder head 2, and supports the EGR cooler 8, the EGR valve 7, and the spacer 400. The exhaust circulation gas ECG indicated by an arrow passes through the EGR cooler base 550, the EGR cooler 8, and the spacer 400 in this order, and is sent to the EGR valve 7.

The spacer 400 is disposed partway along the direction of flow of the exhaust circulation gas ECG indicated by the arrow, on the EGR gas path 23 serving as the exhaust circulation path. More specifically, the spacer 400 is disposed between a terminal end 8M of the EGR cooler 8 and an inlet end 7N of the EGR valve 7. The spacer 400 is formed as thinly as possible regarding the thickness thereof in the direction of flow of the exhaust circulation gas ECG indicated by the arrow (thickness of around 10 mm, for example), in order to prevent the size of the engine 1 from becoming large.

Now, one reason that the EGR differential pressure sensor 203 detects the differential pressure PP on the basis of the pressure Pe of the exhaust circulation gas ECG extracted from between the EGR cooler 8 and the EGR valve 7, using the spacer 400 and the exhaust pressure acquiring path 500, is to enable detection of deterioration of the EGR cooler 8. For example, if the EGR cooler 8 is even slightly blocked by particulate matter, the differential pressure PP that is based on the pressure Pe of the exhaust circulation gas ECG between the EGR cooler 8 and the EGR valve 7 provided on the downstream side of the EGR cooler 8 changes. Accordingly, the exhaust pressure acquiring path 500 is connected to the spacer 400 provided between the terminal end 8M that is the downstream side of the EGR cooler 8, and the inlet end 7N that is the upstream side of the EGR valve 7. The EGR differential pressure sensor 203 detects the differential pressure PP on the basis of the pressure Pe of the exhaust circulation gas ECG at the second pressure measurement unit 223 in the spacer 400.

As illustrated in FIG. 6, the first portion 501 of the exhaust pressure acquiring path 500 has a male screw thread portion 503 at a portion connecting to the spacer 400. The first portion 501 of the exhaust pressure acquiring path 500 is connected to the spacer 400 by the male screw thread portion 503 being fastened to a female screw thread portion 404 of the spacer 400 by a screwing structure. Also, the first portion 501 of the exhaust pressure acquiring path 500 is supported by the spacer 400 via a fixing bracket 520, as illustrated in FIG. 5. The fixing bracket 520 is fixed to the spacer 400 and supports the first portion 501 of the exhaust pressure acquiring path 500, by a bolt 521 being fastened to a female screw thread portion 403 of the spacer 400. The fixing bracket 520 suppresses positional deviation of the first portion 501 of the exhaust pressure acquiring path 500, and also suppresses the exhaust pressure acquiring path 500 from coming loose from the spacer 400 and the EGR differential pressure sensor 203 due to engine vibrations and so forth.

As illustrated in FIG. 6, an attaching face 405 of the spacer 400 with which a seat face of the male screw thread portion 503 comes into contact, and a placement face 406 of the spacer 400 on which the fixing bracket 520 is placed, are provided on the same side face (left side face in FIG. 6) of the spacer 400 as each other. Accordingly, a worker or the like can perform work of attaching the exhaust pressure acquiring path 500 to the spacer 400, and work of attaching the fixing bracket 520 to the spacer 400, from the same side as each other of the outside of the engine 1 in proximity. More preferably, the attaching face 405 of the spacer 400 and the placement face 406 of the spacer 400 are present on the same plane as each other. Accordingly, the attaching face 405 of the spacer 400 and the placement face 406 of the spacer 400 can be machined in the same process as each other, and the configuration of the structure of the spacer 400 can be simplified.

AS illustrated in FIG. 6, the spacer 400 has a gas passage hole 401 that passes exhaust circulation gas ECG and that is circular in shape, two attachment holes 402, 402 provided at positions on both sides of the gas passage hole 401 across the gas passage hole 401, and a gas pressure acquiring hole 410 for extracting the pressure Pe of the exhaust circulation gas ECG at the second pressure measurement unit 223 in the spacer 400. The gas pressure acquiring hole 410 according to the present embodiment is an example of "hole" according to the present invention.

The gas passage hole 401 passes the exhaust circulation gas ECG in a direction perpendicular to the plane of the figure in FIG. 6. Also, positioning studs that are omitted from illustration, provided on the terminal end 8M of the EGR cooler 8 illustrated in FIG. 5, are passed through the holes 402, 402, for example, whereby the spacer 400 is positioned at the terminal end 8M side using the studs.

The gas pressure acquiring hole 410 is formed passing through the spacer 400 in a direction intersecting the flow of the exhaust circulation gas ECG flowing through the EGR gas path 23, e.g., in a perpendicular direction TD. In the structure example of the spacer 400 illustrated in FIG. 6, the gas pressure acquiring hole 410 is provided in the perpendicular direction TD as to the flow of the exhaust circulation gas ECG flowing through the EGR gas path 23, and passes through the spacer 400 via the female screw thread portion 404. In the present specification, to say that "the gas pressure acquiring hole 410 passes through the spacer 400" includes a state in which the gas pressure acquiring hole 410 causes communication of the gas passage hole 401 and the outside of the spacer 400 via another hole, such as the female screw thread portion 404 or the like. The pressure Pe of the exhaust circulation gas ECG at the second pressure measurement unit 223 in the spacer 400 is extracted through the gas pressure acquiring hole 410, and is conveyed to the EGR differential pressure sensor 203 through the exhaust pressure acquiring path 500. In other words, the exhaust pressure acquiring path 500 conveys the pressure Pe of the exhaust circulation gas ECG extracted through the gas pressure acquiring hole 410 to the EGR differential pressure sensor 203. The EGR differential pressure sensor 203 then detects the differential pressure PP between the pressure Pe of the exhaust circulation gas ECG at the second pressure measurement unit 223 that has been extracted through the gas pressure acquiring hole 410 of the spacer 400 and conveyed by the exhaust pressure acquiring path 500, and the pressure Pi of the mixed intake air CYL at the first pressure measurement unit 213 that has been extracted through the intake pressure acquiring path 230 and conveyed.

Note that the direction of an axial center of the gas pressure acquiring hole 410 is not limited to the perpendicular direction TD as to the flow of the exhaust circulation gas ECG flowing through the EGR gas path 23. It is sufficient for the direction of the axial center of the gas pressure acquiring hole 410 to intersect the flow of the exhaust circulation gas ECG flowing through the EGR gas path 23, and may, for example, include a component of a direction against the flow of the exhaust circulation gas ECG flowing through the EGR gas path 23.

The ECU 100 calculates an exhaust circulation air amount mfegr of the exhaust circulation gas ECG in the EGR gas path 23 serving as the exhaust circulation path, on the basis of the differential pressure PP detected by the EGR differential pressure sensor 203 and an opening degree of the EGR valve 7. Calculation of the exhaust circulation air amount mfegr will be described later in detail.

The EGR cooler base 550 is fixed to the cylinder head 2 and an inlet end 8N of the EGR cooler 8. The EGR cooler base 550 is formed thinly, to suppress the engine 1 from becoming large even though the spacer 400 is provided between the EGR valve 7 and the EGR cooler 8. At this time, difference in cross-sectional area of inner channels of the EGR cooler base 550 before and after making the EGR cooler base 550 thinner is suppressed, thereby suppressing change in the flow rate, pressure, and temperature of the exhaust circulation gas ECG flowing through the EGR gas path 23. For example, the cross-sectional area of the narrowest internal channel out of the inner channels of the EGR cooler base 550 is maintained the same before and after making the EGR cooler base 550 thinner. Accordingly, change in the pressure Pe of the exhaust circulation gas ECG at the second pressure measurement unit 223 can be suppressed before and after making the EGR cooler base 550 thinner, and also change in the differential pressure PP detected by the EGR differential pressure sensor 203 can be suppressed therein. Also, change in the basic performance of the EGR (Exhaust Gas Recirculation: exhaust gas recirculation) before and after making the EGR cooler base 550 thinner can be suppressed.

<Computation Example of Air Intake Amount Mfair in Intake Piping 20 Using Air Intake Amount Measurement Device 200>

Next, a computation example of the flow rate of the intake air AR (air intake amount mfair) in the intake piping 20, using the air intake amount measurement device 200, will be described.

Generally, in internal combustion engines such as diesel engines and so forth, an air intake amount sensor (MAF sensor) that detects air intake amount of air (intake air) flowing through intake piping is provided to the intake piping. Note that the air intake amount is the flow rate of air (intake air) flowing through the intake piping, and is also referred to as intake air flow rate, MAF, or the like. However, output characteristics of air intake amount sensors provided to intake piping are dependent on the shape of an intake system (e.g., intake piping) on the upstream side of the air intake amount sensor. The intake system on the upstream side of the air intake amount sensor differs for each application installed in an industrial diesel engine or the like, for example. Accordingly, calibration work of the air intake amount sensor becomes necessary for each application installed in the engine, which is troublesome.

Accordingly, in the air intake amount measurement device 200 according to the present embodiment, the ECU 100 measures the air intake amount mfair in the intake piping 20 in a stable manner with the dependency of measurement results of the air intake amount mfair in the intake piping 20 on the shape of the intake piping 20 suppressed, as described below.

That is to say, in an air intake amount computation method according to the present embodiment, the ECU 100 first calculates the flow rate of the mixed intake air CYL (air intake amount mfcyl) supplied into the cylinders of the first cylinder 11 to the fourth cylinder 14 illustrated in FIG. 1, on the basis of the pressure Pi of the mixed intake air CYL in the intake manifold 3 that is detected by the pressure sensor 201, and the temperature Ti of the mixed intake air CYL in the intake manifold 3 that is detected by the temperature sensor 202. Specifically, the ECU 100 uses a gas state equation to calculate the air intake amount mfcyl of the mixed intake air CYL, on the basis of the pressure Pi of the mixed intake air CYL and the temperature Ti of the mixed intake air CYL. Note that in an engine not provided with an exhaust circulator such as the EGR gas path 23, the above-described air intake amount mfcyl will be a later-described air intake amount mfair of the intake air AR.

Next, the ECU 100 calculates the air intake amount mfair of the intake air AR flowing through the intake piping 20 illustrated in FIG. 1, on the basis of the air intake amount mfcyl of the mixed intake air CYL and the exhaust circulation air amount mfegr of the exhaust circulation gas ECG.

Specifically, the ECU 100 calculates the air intake amount mfair of the intake air AR flowing through the intake piping 20 illustrated in FIG. 1 by computing the difference between the air intake amount mfcyl described above that has been calculated, and the exhaust circulation air amount mfegr of the exhaust circulation gas ECG flowing through the EGR gas path 23.

The exhaust circulation air amount mfegr is stored in advance in ROM or the like of the ECU 100, in a format of an exhaust circulation air amount table (map), as a function of the opening degree of the EGR valve 7 and the differential pressure PP (the differential pressure of the pressure Pi of the mixed intake air CYL and the pressure Pe of the exhaust circulation gas ECG). When performing computation, the ECU 100 reads in the exhaust circulation air amount table (map) stored in ROM or the like of the ECU 100 in advance, in accordance with the opening degree of the EGR valve 7, and the differential pressure PP detected by the EGR differential pressure sensor 203.

In this way, the ECU 100 can compute the air intake amount mfair of new intake air AR in the intake piping 20 illustrated in FIG. 1 on the basis of the pressure Pi of the mixed intake air CYL in the intake manifold 3 detected by the pressure sensor 201 illustrated in FIG. 1, the temperature Ti of the mixed intake air CYL in the intake manifold 3 that is detected by the temperature sensor 202, and the differential pressure PP (differential pressure of the pressure Pi of the mixed intake air CYL and the pressure Pe of the exhaust circulation gas ECG) detected by the EGR differential pressure sensor 203.

Accordingly, the ECU 100 can measure the air intake amount mfair in a stable manner in the air intake amount measurement device 200 and the engine 1 according to the present embodiment, while suppressing the measurement results of the air intake amount mfair from being dependent on the shape of the intake piping 20.

<Set Position of First Pressure Measurement Unit 213 and Temperature Sensor 202>

Next, a set position PS of the first pressure measurement unit 213 and the temperature sensor 202 will be described with reference to FIG. 1 to FIG. 4D.

FIGS. 2A to 2D are schematic diagrams exemplifying results of turbulence energy in CFD fluid analysis carried out by the present inventor.

FIGS. 3A to 3D are schematic diagrams exemplifying results of pressure in CFD fluid analysis carried out by the present inventor.

FIGS. 4A to 4D are schematic diagrams exemplifying results of temperature in CFD fluid analysis carried out by the present inventor.

Figure 2A:
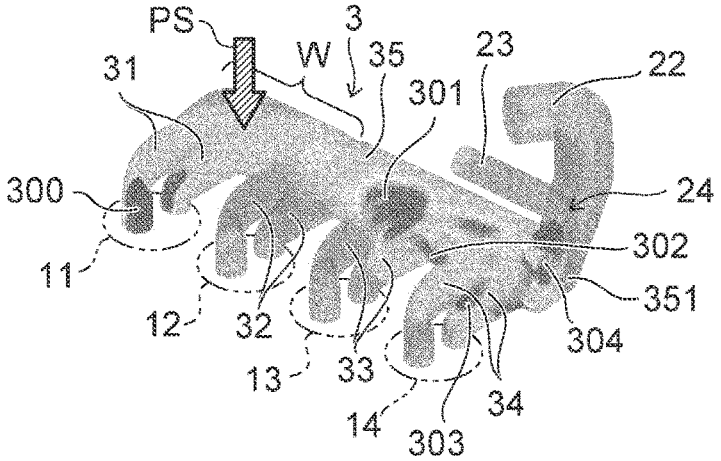
FIGS. 2A to 2D are schematic diagrams exemplifying results of turbulence energy in CFD fluid analysis carried out by the present inventor.
Figure 2B:
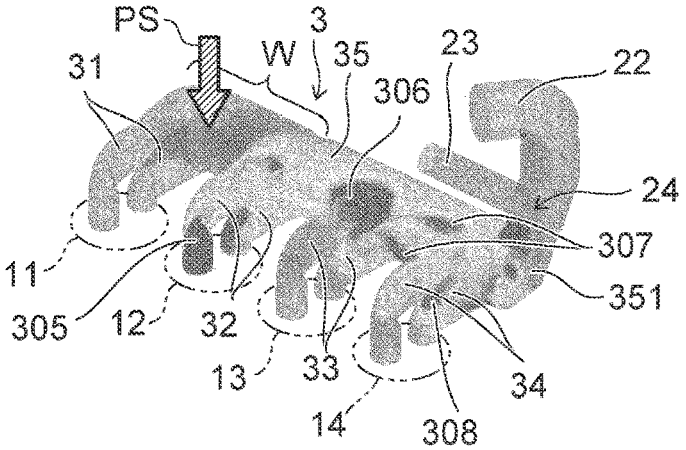
Figure 2C:
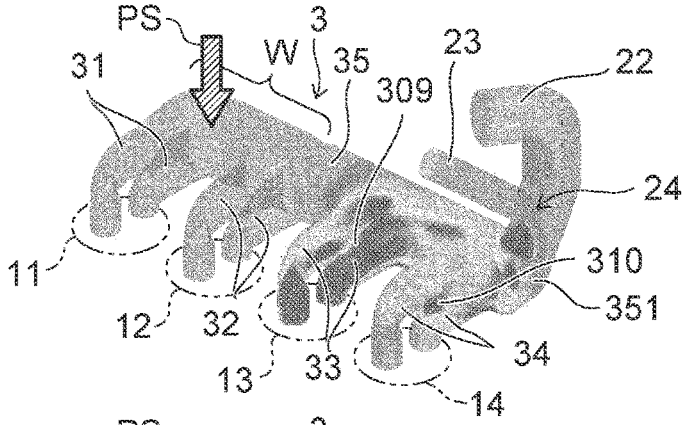
Figure 2D:
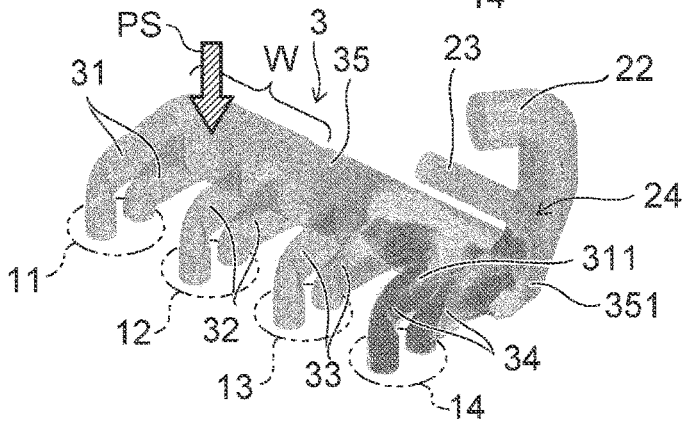
Figure 3A:
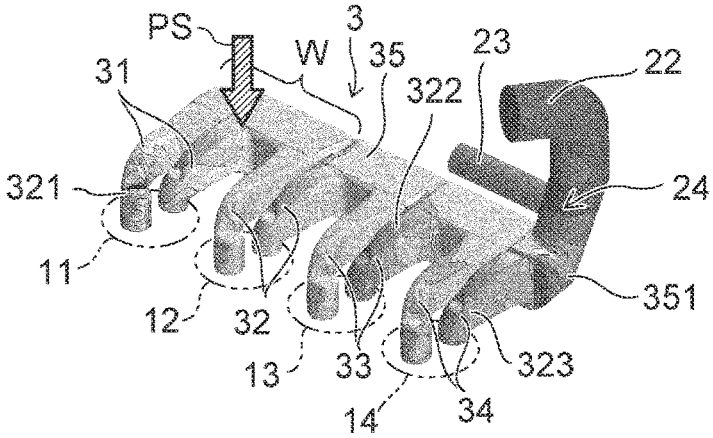
FIGS. 3A to 3D are schematic diagrams exemplifying results of pressure in CFD fluid analysis carried out by the present inventor.
Figure 3B:
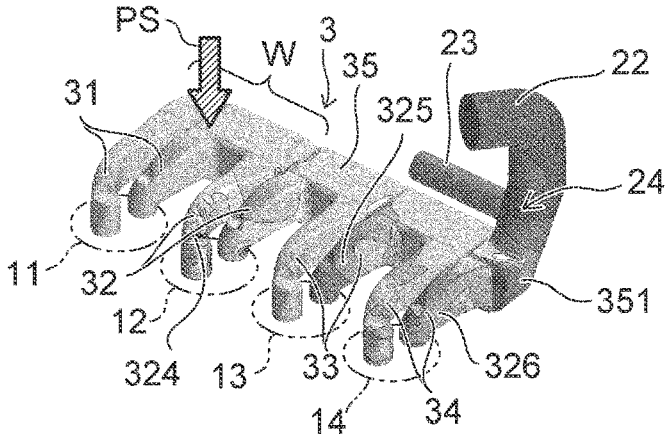
Figure 3C:
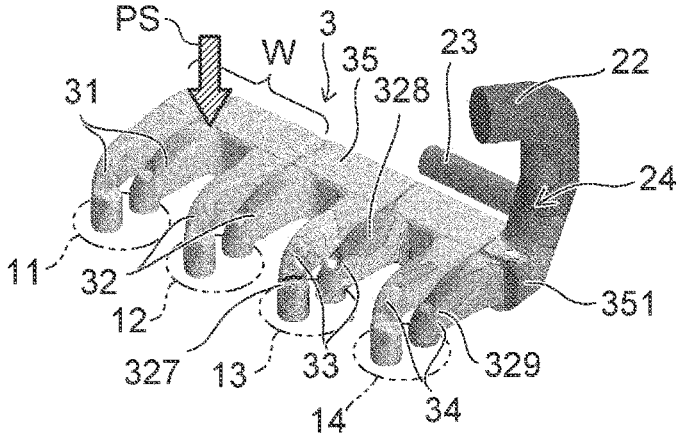
Figure 3D:
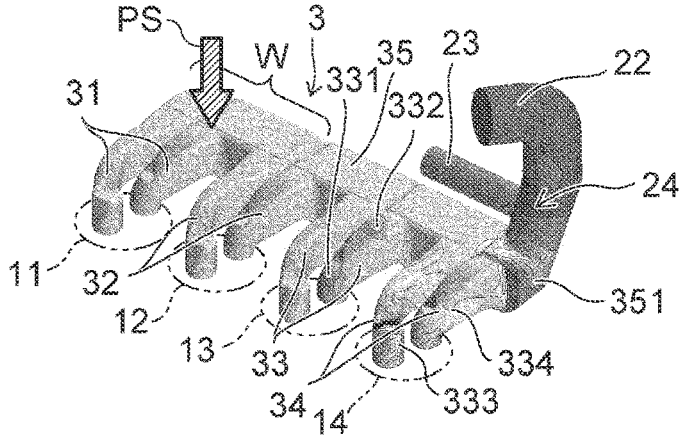
Figure 4A:
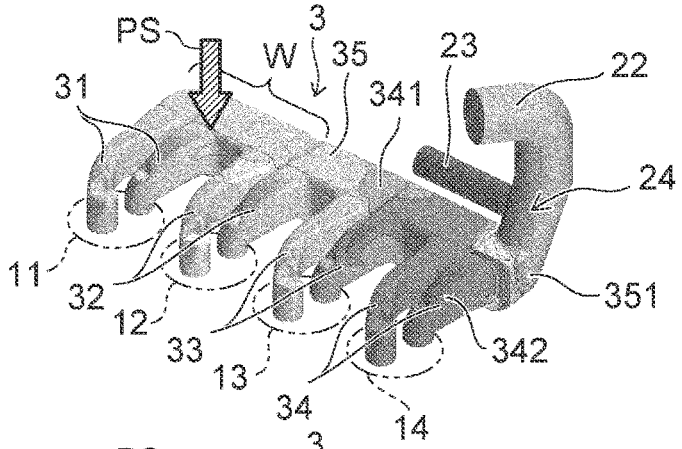
FIGS. 4A to 4D are schematic diagrams exemplifying results of temperature in CFD fluid analysis carried out by the present inventor.
Figure 4B:
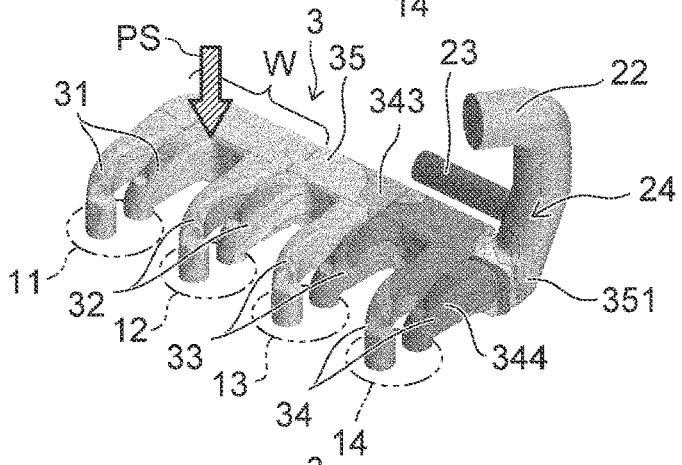
Figure 4C:
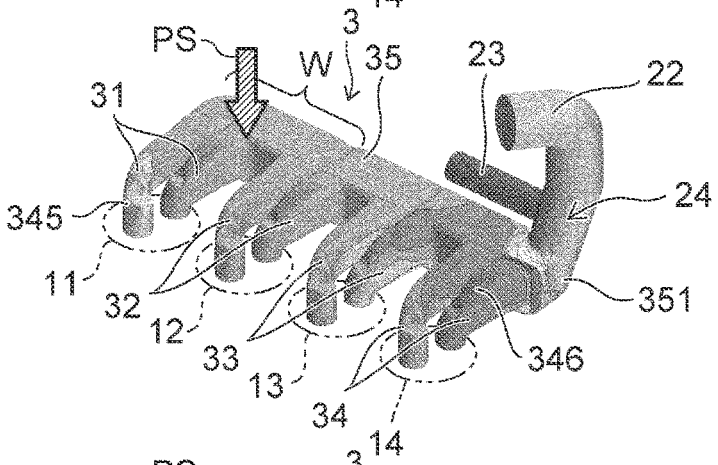
Figure 4D:
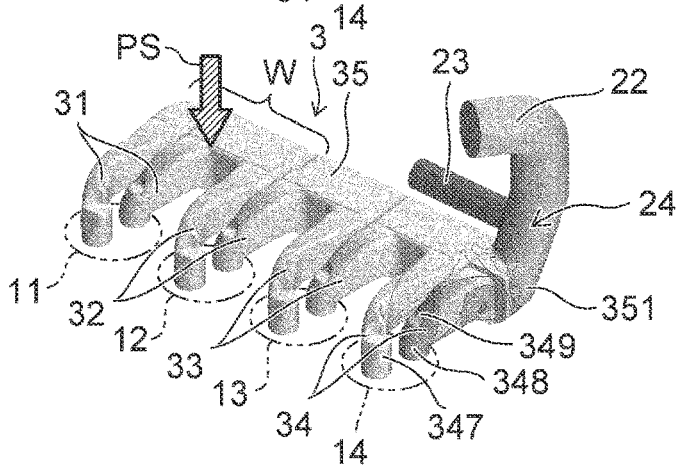

Note that FIG. 2A, FIG. 3A, and FIG. 4A are schematic diagrams exemplifying analysis results in the intake stroke of the first cylinder 11. FIG. 2B, FIG. 3B, and FIG. 4B are schematic diagrams exemplifying analysis results in the intake stroke of the second cylinder 12. FIG. 2C, FIG. 3C, and FIG. 4C are schematic diagrams exemplifying analysis results in the intake stroke of the third cylinder 13. FIG. 2D, FIG. 3D, and FIG. 4D are schematic diagrams exemplifying analysis results in the intake stroke of the fourth cylinder 14.

In order to even further suppress dependency of the measurement results of the air intake amount mfair on the shape of the intake piping 20, and to measure the air intake amount mfair in an even more stable manner, the first pressure measurement unit 213 and the temperature sensor 202 are preferably installed at a position where pulsation of the mixed intake air CYL in the intake manifold 3 is relatively smaller, i.e., a position at which the flow of the mixed intake air CYL in the intake manifold 3 is relatively stable. Pulsation of the mixed intake air CYL in the intake manifold 3 is affected by opening/closing operations of intake values (omitted from illustration) and exhaust valves (omitted from illustration) of the engine 1, and mixing of the intake air AR and the exhaust circulation gas ECG.

Accordingly, the present inventor performed CFD (computational fluid dynamics: Computational Fluid Dynamics) fluid analysis such as exemplified below, in order to confirm turbulence energy, pressure, and temperature of the mixed intake air CYL in the intake manifold 3.

That is to say, to describe an overview of analysis conditions (physical model), the subject fluid is a three-dimensional gas (air), and is an incompressible fluid (constant density). The flow of the subject fluid is a turbulent flow, and also is a steady flow. The turbulent flow model is a Realizable k-E model. The velocity distribution of the subject fluid in the proximity of the wall face are based on a wall function (two-layer All y+ model). The solver is a segregated solver. No heat-transfer calculations are performed. The standard calculation grid size is 5 mm.

Also, as for analysis conditions, the engine is a turbo diesel engine. The rated revolutions of the engine are 2600 rpm. The engine is subjected to full load. The engine is an EGR-specifications engine having the EGR gas path 23, the EGR valve 7, and the EGR cooler 8.

The intake manifold 3 that is the subject of analysis has the main pipe 35 that has the inlet end 351 where intake air flows in on one end, and the first branch pipe 31, the second branch pipe 32, the third branch pipe 33, and the fourth branch pipe 34, that branch from the main pipe 35, as illustrated in FIG. 2A to FIG. 4D. The longitudinal direction of the main pipe 35 extends following the direction in which the first cylinder 11, the second cylinder 12, the third cylinder 13, and the fourth cylinder 14 are arrayed, i.e., in the direction in which the crankshaft extends. The first branch pipe 31, the second branch pipe 32, the third branch pipe 33, and the fourth branch pipe are respectively connected to the first cylinder 11, the second cylinder 12, the third cylinder 13, and the fourth cylinder 14 of the engine 1.

In the examples illustrated in FIG. 2A to FIG. 4D, the intake manifold 3 has two each of the first branch pipe 31, the second branch pipe 32, the third branch pipe 33, and the fourth branch pipe 34. That is to say, two each of the first branch pipe 31, the second branch pipe 32, the third branch pipe 33, and the fourth branch pipe 34, are respectively connected to the first cylinder 11, the second cylinder 12, the third cylinder 13, and the fourth cylinder 14 of the engine 1. Note however, that the number of the branch pipes of the intake manifold 3 connected to each cylinder of the engine 1 is not limited to this. For example, one each of the first branch pipe 31, the second branch pipe 32, the third branch pipe 33, and the fourth branch pipe 34, may be respectively connected to the first cylinder 11, the second cylinder 12, the third cylinder 13, and the fourth cylinder 14 of the engine 1.

The inlet flange 22 that causes intake air to flow into the intake manifold 3 is connected to the inlet end 351 of the intake manifold 3. The inlet flange 22 has the EGR gas path 23 that circulates exhaust gas of the engine 1. Exhaust gas circulated by the EGR gas path 23 is mixed with the intake air at the mixing portion 24 inside the inlet flange 22, and thereafter flows into the inlet end 351 of the intake manifold 3.

An example of results of turbulence energy of the subject fluid by the CFD fluid analysis carried out on the basis of the above-described analysis conditions overview (physical model), and the analysis conditions, is as illustrated in FIGS. 2A to 2D. Also, an example of results of pressure of the subject fluid by the CFD fluid analysis is as illustrated in FIGS. 3A to 3D. Further, an example of results of temperature of the subject fluid by the CFD fluid analysis is as illustrated in FIGS. 4A to 4D.

As illustrated in FIG. 2A to FIG. 2D, in each intake stroke of the first cylinder 11, the second cylinder 12, the third cylinder 13, and the fourth cylinder 14, turbulence energy of the subject fluid in the vicinity of the third cylinder 13 and the fourth cylinder 14 in the intake manifold 3 is greater in comparison with the turbulence energy of the subject fluid in the vicinity of the first cylinder 11 and the second cylinder 12. The turbulence energy represents the magnitude of disturbance in the flow of the subject fluid. Accordingly, the example of analysis results represented in FIG. 2A to FIG. 2D suggests that the flow field in the vicinity of the third cylinder 13 and the fourth cylinder 14 in the intake manifold 3 tends to be more unstable than the flow field in the vicinity of the first cylinder 11 and the second cylinder 12. In other words, the example of the analysis results represented in FIG. 2A to FIG. 2D suggests that the flow of the subject fluid in the vicinity of the first cylinder 11 and the second cylinder 12 is more stable than the flow of the subject fluid in the vicinity of the third cylinder 13 and the fourth cylinder 14 in the intake manifold 3.

To describe this in detail, as illustrated in FIG. 2A, in the intake stroke of the first cylinder 11, the turbulence energy of the subject fluid in a region 300 of the first branch pipe 31, and a region 301, a region 302, a region 303, and a region 304 of the third branch pipe 33 to the fourth branch pipe 34 is greater than the turbulence energy of the subject fluid in other regions. Also, as illustrated in FIG. 2B, in the intake stroke of the second cylinder 12, the turbulence energy of the subject fluid in a region 305 of the second branch pipe 32, a region 306, a region 307, and a region 308 of the third branch pipe 33 to the fourth branch pipe 34 is greater than the turbulence energy of the subject fluid in other regions. Also, as illustrated in FIG. 2C, in the intake stroke of the third cylinder 13, the turbulence energy of the subject fluid in a region 309 and a region 310 of the third branch pipe 33 to the fourth branch pipe 34 is greater than the turbulence energy of the subject fluid in other regions. Also, as illustrated in FIG. 2D, in the intake stroke of the fourth cylinder 14, the turbulence energy of the subject fluid in a region 311 of the fourth branch pipe 34 is greater than the turbulence energy of the subject fluid in other regions.

With reference to FIG. 2A to FIG. 2D, the turbulence energy of the subject fluid in a region W spanning the first branch pipe 31 connected to the first cylinder 11 to the second branch pipe 32 connected to the second cylinder 12 in the intake manifold 3, and particularly at the position PS between the first branch pipe 31 connected to the first cylinder 11 and the second branch pipe 32 connected to the second cylinder 12, is relatively low. Accordingly, it can be understood that the flow of the subject fluid is relatively stable in the region W in the intake manifold 3, and particularly at the position PS.

Also, as illustrated in FIG. 3A to FIG. 3D, in each intake stroke of the first cylinder 11, the second cylinder 12, the third cylinder 13, and the fourth cylinder 14, pressure of the subject fluid in the vicinity of the first cylinder 11 and the second cylinder 12 in the intake manifold 3 is more stable comparison with the pressure of the subject fluid in the vicinity of the third cylinder 13 and the fourth cylinder 14.

To describe this in detail, as illustrated in FIG. 3A, in the first cylinder intake stroke, the pressure of the subject fluid in the region W is higher than the pressure of the subject fluid in a region 321 of the first branch pipe 31, and is lower than the pressure of the subject fluid in a region 322 and a region 323 of the third branch pipe 33 to the fourth branch pipe 34. Also, as illustrated in FIG. 3B, in the second cylinder intake stroke, the pressure of the subject fluid in the region W is higher than the pressure of the subject fluid in a region 324 of the second branch pipe 32, and is lower than the pressure of the subject fluid in a region 325 and a region 326 of the third branch pipe 33 to the fourth branch pipe 34. Also, as illustrated in FIG. 3C, in the third cylinder intake stroke, the pressure of the subject fluid in the region W is higher than the pressure of the subject fluid in a region 327 of the third branch pipe 33, and is lower than the pressure of the subject fluid in a region 328 and a region 329 of the third branch pipe 33 to the fourth branch pipe 34. Also, as illustrated in FIG. 3D, in the fourth cylinder intake stroke, the pressure of the subject fluid in the region W is lower than the pressure of the subject fluid in region a 331 and a region 332 of the third branch pipe 33, and is higher than the pressure of the subject fluid in a region 333 and a region 334 of the fourth branch pipe 34.

With reference to FIG. 3A to FIG. 3D, fluctuation in pressure of the subject fluid in the region W spanning the first branch pipe 31 connected to the first cylinder 11 to the second branch pipe 32 connected to the second cylinder 12 in the intake manifold 3, and particularly at the position PS between the first branch pipe 31 connected to the first cylinder 11 and the second branch pipe 32 connected to the second cylinder 12, is relatively small. That is to say, the pressure of the subject fluid is relatively stable in the region W in the intake manifold 3, and particularly at the position PS.

Also, as illustrated in FIG. 4A to FIG. 4D, in each intake stroke of the first cylinder 11, the second cylinder 12, the third cylinder 13, and the fourth cylinder 14, the temperature of the subject fluid in the vicinity of the first cylinder 11 and the second cylinder 12 in the intake manifold 3 is more stable comparison with the temperature of the subject fluid in the vicinity of the third cylinder 13 and the fourth cylinder 14.

To describe this in detail, as illustrated in FIG. 4A, in the first cylinder intake stroke, the temperature of the subject fluid in the region W is lower than the temperature of the subject fluid in a region 341 and a region 342 of the third branch pipe 33 to the fourth branch pipe 34. Also, as illustrated in FIG. 4B, in the second cylinder intake stroke, the temperature of the subject fluid in the region W is lower than the temperature of the subject fluid in a region 343 and a region 344 of the third branch pipe 33 to the fourth branch pipe 34. Also, as illustrated in FIG. 4C, in the third cylinder intake stroke, the temperature of the subject fluid in the region W is higher than the temperature of the subject fluid in a region 345 of the first branch pipe 31, and lower than the temperature of the subject fluid in a region 346 of the third branch pipe 33 to the fourth branch pipe 34. Also, as illustrated in FIG. 4D, in the fourth cylinder intake stroke, the temperature of the subject fluid in the region W is lower than the temperature of the subject fluid in a region 347, a region 348, and a region 349 of the fourth branch pipe 34.

With reference to FIG. 4A to FIG. 4D, fluctuation in temperature of the subject fluid in the region W spanning the first branch pipe 31 connected to the first cylinder 11 to the second branch pipe 32 connected to the second cylinder 12 in the intake manifold 3, and particularly at the position PS between the first branch pipe 31 connected to the first cylinder 11 and the second branch pipe 32 connected to the second cylinder 12, is relatively small. That is to say, the temperature of the subject fluid is relatively stable in the region W in the intake manifold 3, and particularly at the position PS.

According to the results of CFD fluid analysis carried out by the present inventor, when viewed following the direction in which the first cylinder 11, the second cylinder 12, the third cylinder 13, and the fourth cylinder 14 are arrayed, i.e., in the longitudinal direction of the main pipe 35 of the intake manifold 3, the turbulence energy of the subject fluid is relatively low, and the pressure and the temperature of the subject fluid are relatively stable, at the region far from the inlet end 351 out of the regions in the intake manifold 3. Accordingly, the first pressure measurement unit 213 and the temperature sensor 202 are preferably installed at the region far from the inlet end 351 out of the regions in the intake manifold 3, when viewed following the direction in which the first cylinder 11, the second cylinder 12, the third cylinder 13, and the fourth cylinder 14 are arrayed, i.e., in the longitudinal direction of the main pipe 35 of the intake manifold 3. More specifically, the first pressure measurement unit 213 and the temperature sensor 202 are preferably installed in the region W spanning the first branch pipe 31 connected to the first cylinder 11 and the second branch pipe 32 connected to the second cylinder 12, and particularly at the position PS between the first branch pipe 31 connected to the first cylinder 11 and the second branch pipe 32 connected to the second cylinder 12.

According to the air intake amount measurement device 200 of the present embodiment, the temperature sensor 202 detects the temperature Ti of the mixed intake air CYL in the region W spanning the first branch pipe 31 connected to the first cylinder 11 and the second branch pipe 32 connected to the second cylinder 12. As described above, the first branch pipe 31 is connected to the first cylinder 11 that is disposed at the position farthest from the inlet end 351 of the intake manifold 3 in the longitudinal direction of the intake manifold 3. The second branch pipe 32 is connected to the second cylinder 12 that is disposed at a position next farthest from the inlet end 351 of the intake manifold 3 in the longitudinal direction of the intake manifold 3 after the first cylinder 11. The ECU 100 computes the air intake amount mfcyl of the mixed intake air CYL and the air intake amount mfair of the intake air AR, on the basis of the temperature Ti of the mixed intake air CYL transmitted from the temperature sensor 202, and the pressure Pi of the mixed intake air CYL transmitted from the pressure sensor 201. That is to say, in an engine provided with an exhaust circulator such as the EGR gas path 23, the ECU 100 calculates the air intake amount mfair of the intake air AR by computing the difference between the air intake amount mfcyl of the mixed intake air CYL and the exhaust circulation air amount mfegr of the exhaust circulation gas ECG. Conversely, in an engine not provided with an exhaust circulator such as the EGR gas path 23, the ECU 100 calculates the air intake amount mfair of the intake air AR assuming the air intake amount mfcyl of the mixed intake air CYL to be equivalent to the air intake amount mfair of the intake air AR.

In this way, the temperature sensor 202 detects the temperature Ti of the mixed intake air CYL at a region where the flow of the mixed intake air CYL is relatively stable out of the regions in the intake manifold 3. The ECU 100 computes the air intake amount mfcyl of the mixed intake air CYL and the air intake amount mfair of the intake air AR on the basis of the temperature Ti of the mixed intake air CYL transmitted from the temperature sensor 202 and the pressure Pi of the mixed intake air CYL transmitted from the pressure sensor 201 without depending on an intake amount sensor (MAF sensor) that detects the flow rate of the intake air AR flowing through the intake piping 20. Accordingly, the air intake amount measurement device 200 of the present embodiment can measure the air intake amount mfair of the intake air AR in a stable manner, by suppressing the measurement results of the air intake amount mfair of the intake air AR flowing through the intake piping 20 from being dependent on the shape of the intake piping 20.

Also, the pressure sensor 201 detects the pressure Pi of the mixed intake air CYL at a region where the flow of the mixed intake air CYL is relatively stable out of the regions in the intake manifold 3. As described above, ECU 100 computes the air intake amount mfcyl of the mixed intake air CYL and the air intake amount mfair of the intake air AR on the basis of the temperature Ti of the mixed intake air CYL transmitted from the temperature sensor 202 and the pressure Pi of the mixed intake air CYL transmitted from the pressure sensor 201 without depending on an intake amount sensor (MAF sensor) that detects the flow rate of the intake air AR flowing through the intake piping 20. Accordingly, the air intake amount measurement device 200 of the present embodiment can measure the air intake amount mfair of the intake air AR in an even more stable manner, by further suppressing the measurement results of the air intake amount mfair of the intake air AR flowing through the intake piping 20 from being dependent on the shape of the intake piping 20.

Also, as illustrated in FIG. 1, the first pressure measurement unit 213 is provided at a position that is closer to the inlet end 351 of the intake manifold 3 than the temperature sensor 202, in the longitudinal direction of the intake manifold 3. Accordingly, the pressure sensor 201 detects the pressure Pi of the mixed intake air CYL at a position closer to the inlet end 351 in the longitudinal direction of the intake manifold 3 than the mixed intake air CYL of which the temperature Ti is detected by the temperature sensor 202. Accordingly, the pressure sensor 201 detects the pressure Pi not of the mixed intake air CYL in a region where the flow has been disturbed by a probe or the like of the temperature sensor 202 installed in the intake manifold 3 for example, but of the mixed intake air CYL in a region before disturbance of the flow, where the flow is more stable. Accordingly, the pressure sensor 201 can detect the pressure Pi of the mixed intake air CYL in a more stable manner. Thus, the air intake amount measurement device 200 according to the present embodiment can measure the air intake amount mfair of the intake air AR in an even more stable manner, by further suppressing the measurement results of the air intake amount mfair of the intake air AR flowing through the intake piping 20 from being dependent on the shape of the intake piping 20.

Also, the first pressure measurement unit 213 is provided at the region W spanning the first branch pipe 31 and the second branch pipe 32, and accordingly the EGR differential pressure sensor 203 detects the differential pressure PP between the pressure Pi of the mixed intake air CYL in a region where the flow of the mixed intake air CYL is relatively stable out of the regions in the intake manifold 3, and the pressure Pe of the exhaust circulation gas ECG at the second pressure measurement unit 223 provided in the EGR gas path 23. The ECU 100 then computes the air intake amount mfcyl of the mixed intake air CYL and the air intake amount mfair of the intake air AR on the basis of the temperature Ti of the mixed intake air CYL transmitted from the temperature sensor 202, the pressure Pi of the mixed intake air CYL transmitted from the pressure sensor 201, and the differential pressure PP transmitted from the EGR differential pressure sensor 203. Accordingly, in a case of providing an exhaust circulator circulating exhaust of the engine 1, the air intake amount measurement device 200 according to the present embodiment can improve the computation precision of the air intake amount mfair of the intake air AR flowing through the intake piping 20.

Also, the first pressure measurement unit 213 is provided at a position closer to the inlet end 351 of the intake manifold 3 than the temperature sensor 202 in the longitudinal direction of the intake manifold 3, and accordingly the EGR differential pressure sensor 203 detects the differential pressure PP on the basis of the pressure Pi of the mixed intake air CYL at a position closer to the inlet end 351 in the longitudinal direction of the intake manifold 3 than the mixed intake air CYL where the temperature Ti is detected by the temperature sensor 202. Accordingly, the EGR differential pressure sensor 203 detects the differential pressure PP on the basis of the pressure Pi not of the mixed intake air CYL in a region where the flow has been disturbed by a probe or the like of the temperature sensor 202 installed in the intake manifold 3 for example, but of the mixed intake air CYL in a region before disturbance of the flow, where the flow is more stable. Therefore, the EGR differential pressure sensor 203 can detect the differential pressure PP in a more stable manner. Thus, in a case of providing an exhaust circulator circulating exhaust of the engine 1, the air intake amount measurement device 200 according to the present embodiment can improve the computation precision of the air intake amount mfair of the intake air AR flowing through the intake piping 20.

Also, the EGR differential pressure sensor 203 detects the differential pressure PP on the basis of the pressure Pi of the mixed intake air CYL at the same position in the longitudinal direction of the intake manifold 3 as the mixed intake air CYL of which the pressure Pi is detected by the pressure sensor 201 (i.e., the first pressure measurement unit 213). That is to say, the detection position of the pressure Pi of the mixed intake air CYL by the EGR differential pressure sensor 203 is the same as the detection position of the pressure Pi of the mixed intake air CYL by the pressure sensor 201, i.e., the position of the region W spanning the first branch pipe 31 and the second branch pipe 32. Accordingly, the pressure Pi of the mixed intake air CYL in the intake manifold 3 for detecting the differential pressure PP by the EGR differential pressure sensor 203 and the pressure Pi of the mixed intake air CYL in the intake manifold 3 that is detected by the pressure sensor 201 are temporally synchronized with each other. Thus, the ECU 100 calculates the air intake amount mfcyl of the mixed intake air CYL and the exhaust circulation air amount mfegr of the exhaust circulation gas ECG from one system in the intake manifold 3, i.e., a system of which the state is the same. Accordingly, in a case of providing an exhaust circulator circulating exhaust of the engine 1, the air intake amount measurement device 200 according to the present embodiment can improve the computation precision of the air intake amount mfair of the intake air AR flowing through the intake piping 20.

Also, the second pressure measurement unit 223 is provided in the EGR gas path 23 between the EGR cooler 8 and the EGR valve 7. Accordingly, the EGR differential pressure sensor 203 detects the differential pressure PP on the basis of the pressure Pe of the exhaust circulation gas ECG that is between the EGR cooler 8 and the EGR valve 7. Thus, the ECU 100 can estimate the state of deterioration or the degree of deterioration of the EGR cooler 8 on the basis of the differential pressure PP transmitted from the EGR differential pressure sensor 203.

Also, the spacer 400 is provided on the EGR gas path 23 between the EGR cooler 8 and the EGR valve 7. The EGR differential pressure sensor 203 detects the differential pressure PP on the basis of the pressure Pe of the exhaust circulation gas ECG extracted through the gas pressure acquiring hole 410 of the spacer 400. Accordingly, the exhaust pressure acquiring path 500 that transmits the pressure Pe of the exhaust circulation gas ECG to the EGR differential pressure sensor 203 is capable of being connected to the spacer 400 in a sure manner, without hardly being subjected to any structural restriction from the EGR valve 7 and the EGR cooler 8. Also, the exhaust pressure acquiring path 500 made of various types of piping and so forth to convey the pressure Pe of the exhaust circulation gas ECG to the EGR differential pressure sensor 203 can be easily connected to the spacer 400 even without changing the structures of the EGR cooler 8 and the EGR valve 7, by changing the structure of the spacer 400. Further, the gas pressure acquiring hole 410 of the spacer 400 is formed passing through in a direction intersecting the flow of the exhaust circulation gas ECG flowing through the EGR gas path 23. Accordingly, the gas pressure acquiring hole 410 of the spacer 400 can be suppressed from being blocked by particulate matter (PM: Particulate Matter) contained in the exhaust circulation gas ECG. Accordingly, the EGR differential pressure sensor 203 can acquire the pressure (static pressure) Pe of the exhaust circulation gas ECG in a more sure manner, and can detect the differential pressure PP on the basis of the pressure (static pressure) Pe of the exhaust circulation gas ECG with even higher precision.

Also, the exhaust pressure acquiring path 500 is connected to the spacer 400 and the EGR differential pressure sensor 203, and conveys the pressure Pe of the exhaust circulation gas ECG extracted through the gas pressure acquiring hole 410 of the spacer 400 to the EGR differential pressure sensor 203. Of the exhaust pressure acquiring path 500, at least the first portion 501 connected to the spacer 400 is made of metal. Accordingly, the first portion 501 of the exhaust pressure acquiring path 500 that is connected to the spacer 400 can be suppressed from deteriorating or hardening under heat of the exhaust circulation gas ECG flowing through the EGR gas path 23. Thus, a gap can be suppressed from being formed between the first portion 501 of the exhaust pressure acquiring path 500 that is connected to the spacer 400, and the spacer 400, and air on the outside of the exhaust pressure acquiring path 500 can be suppressed from intruding into the exhaust pressure acquiring path 500. Accordingly, the EGR differential pressure sensor 203 can detect the differential pressure PP with even higher precision. Also, the first portion 501 of the exhaust pressure acquiring path 500 that is connected to the spacer 400 is made of metal, and accordingly the exhaust pressure acquiring path 500 can be fastened to the spacer 400 using a screw structure. Thus, the exhaust pressure acquiring path 500 can be suppressed from coming loose from the spacer 400, and positioning of the exhaust pressure acquiring path 500 to the spacer 400 can be easily performed.

Also, out of the exhaust pressure acquiring path 500, the second portion 502 connected to the EGR differential pressure sensor 203 is made of a resin such as engineering plastic, rubber, or the like, which is flexible and is tolerant of heat. Accordingly, even though the first portion 501 of the exhaust pressure acquiring path 500 is made of metal, the second portion 502 of the exhaust pressure acquiring path 500 can be easily connected to the EGR differential pressure sensor 203, flexibly handling the position of the EGR differential pressure sensor 203.

An embodiment of the present invention has been described above. However, the present invention is not limited to the above embodiment, and various modifications may be made without departing from the scope of the claims. Part of the above-described configurations of the embodiment may be omitted, or optionally combined differently from the above description.

For example, the engine 1 according to the present embodiment is exemplified as an example of the engine according to the present invention. The engine 1 is a supercharged diesel engine equipped with a turbocharger. However, this is not limiting, and the engine according to the present invention may be a naturally aspirated diesel engine, a supercharged gasoline engine equipped with a turbocharger, a naturally aspirated gasoline engine, or the like. Also, the type of the engine 1 is a multicylinder engine, such as a supercharged high-output four-cylinder engine or the like, equipped with a turbocharger, for example. However, the type of the engine 1 is not limited to this alone, and may be an engine with three cylinders, or five cylinders or more. The engine 1 may be installed in vehicles of types other than vehicles, such as, for example, construction equipment, farming equipment, lawnmowers, and so forth.

REFERENCE SIGNS LIST

1 Engine
2 Cylinder head
3 Intake manifold
4 Exhaust manifold
4B Exhaust channel
5 Turbocharger
5B Blower
5T Turbine
6 Intake throttle valve
7 EGR valve
8 EGR cooler
11 First cylinder
12 Second cylinder
13 Third cylinder
14 Fourth cylinder
15 Fuel injection valve
16 Common rail
19 Diesel particulate filter
20 Intake piping
21 Intake channel
22 Inlet flange
23 EGR gas path

23M Inlet end
23N Terminal end
24 Mixing portion
31 First branch pipe
32 Second branch pipe
33 Third branch pipe
34 Fourth branch pipe
35 Main pipe
100 ECU
200 Air intake amount measurement device
201 Pressure sensor
202 Temperature sensor
203 EGR differential pressure sensor
213 First pressure measurement unit
223 Second pressure measurement unit
230 Intake pressure acquiring path
351 Inlet end
400 Spacer
401 Gas passage hole
402 Hole
403 Female screw thread portion
404 Female screw thread portion
405 Attaching face
406 Placement face
410 Gas pressure acquiring hole
500 Exhaust pressure acquiring path
501 First portion
502 Second portion
503 Male screw thread portion
520 Fixing bracket
521 Bolt
550 EGR cooler base
AR Intake air
CYL Mixed intake air
ECG Exhaust circulation gas
EG Exhaust gas
PP Differential pressure
PS Set position
Pe, Pi Pressure
Ti Temperature
W Region
mfair, mfcyl air intake amount
mfegr Exhaust circulation air amount

The invention claimed is:

1. An air intake amount measurement device that measures a flow rate of intake air of an engine that has three or more inline cylinders, the air intake amount measurement device comprising:

an intake distributor distributing the intake air to the cylinders of the engine;

a temperature detector detecting a temperature of the intake air;

a pressure detector detecting a pressure of the intake air; and a computing unit that computes the flow rate on the basis of the temperature transmitted from the temperature detector and the pressure transmitted from the pressure detector, wherein a longitudinal direction of the intake distributor follows a direction in which the cylinders of the engine are arrayed, the intake air flows into the intake distributor from one end thereof in the longitudinal direction, and the temperature detector detects the temperature of the intake air at a region spanning, out of an inside of the intake distributor, a first branch portion of the intake distributor that is connected to a first cylinder of the engine disposed at a position farthest from the one end in the longitudinal direction, and a second branch portion of the intake distributor that is connected to a second cylinder of the engine disposed at a position next farthest from the one end in the longitudinal direction after the first cylinder.

2. The air intake amount measurement device according to claim 1, wherein the pressure detector detects the pressure of the intake air at the region.

3. The air intake amount measurement device according to claim 2, wherein the pressure detector detects the pressure of the intake air at a position closer to the one end in the longitudinal direction as compared to the intake air of which the temperature is detected by the temperature detector.

4. The air intake amount measurement device according to claim 1, further comprising:

an exhaust circulator circulating exhaust of the engine; and a differential pressure detector detecting a differential pressure between the exhaust flowing through the exhaust circulator and the intake air flowing through the intake distributor, and transmits the differential pressure to the computing unit, wherein the computing unit further computes the flow rate on the basis of the differential pressure transmitted from the differential pressure detector, and the differential pressure detector detects the differential pressure on the basis of the pressure of the intake air at the region.

5. The air intake amount measurement device according to claim 4, wherein the differential pressure detector detects the differential pressure on the basis of the pressure of the intake air at a position closer to the one end in the longitudinal direction as compared to the intake air of which the temperature is detected by the temperature detector.

6. The air intake amount measurement device according to claim 5, wherein the differential pressure detector detects the differential pressure on the basis of the pressure of the intake air at a same position in the longitudinal direction as the intake air of which the pressure is detected by the pressure detector.

7. The air intake amount measurement device according to claim 4, wherein the differential pressure detector detects the differential pressure on the basis of the pressure of the exhaust between a cooler cooling the exhaust flowing through the exhaust circulator, and a flow rate adjustor adjusting a flow rate of the exhaust flowing through the exhaust circulator on a downstream side of the cooler.

8. The air intake amount measurement device according to claim 7, further comprising:

a spacer provided to the exhaust circulator between the cooler and the flow rate adjustor, wherein the spacer has a hole formed passing through in a direction intersecting a flow of the exhaust flowing through the exhaust circulator, and the differential pressure detector detects the differential pressure on the basis of the pressure of the exhaust extracted through the hole of the spacer.

9. The air intake amount measurement device according to claim 8, further comprising:

an exhaust pressure acquiring path that is connected to the spacer and the differential pressure detector, and that conveys a pressure of the exhaust extracted through the hole to the differential pressure detector, wherein at least a portion of the exhaust pressure acquiring path connected to the spacer is made of metal.

10. An engine that is equipped with an air intake amount measurement device that measures a flow rate of intake air, and that has three or more inline cylinders, wherein the air intake amount measurement device includes an intake distributor distributing the intake air to the cylinders of the engine, a temperature detector detecting a temperature of the intake air, a pressure detector detecting a pressure of the intake air, and a computing unit that computes the flow rate on the basis of the temperature transmitted from the temperature detector and the pressure transmitted from the pressure detector, a longitudinal direction of the intake distributor follows a direction in which the cylinders of the engine are arrayed, the intake air flows into the intake distributor from one end thereof in the longitudinal direction, and the temperature detector detects the temperature of the intake air at a region spanning, out of an inside of the intake distributor, a first branch portion of the intake distributor that is connected to a first cylinder of the engine disposed at a position farthest from the one end in the longitudinal direction, and a second branch portion of the intake distributor that is connected to a second cylinder of the engine disposed at a position next farthest from the one end in the longitudinal direction after the first cylinder.

* * * * *